US005546640A

United States Patent [19]

Krönauer et al.

[11] Patent Number: 5,546,640

[45] Date of Patent: Aug. 20, 1996

[54] CLAMP

[75] Inventors: Karlhans Krönauer, Ilmmünster; Josef Aigner, Gosseltshausen; Franz Klein, Pfaffenhofen/Ilm; Karsten Weber, Pfaffenhofen/Ilm; Monika Schmid, Pfaffenhofen/Ilm; Robert Pfab, Brunnen-Hohenried, all of Germany

[73] Assignee: Mawa Metallwarenfabrik Wagner GmbH, Pfaffenhofen, Germany

[21] Appl. No.: 302,811

[22] PCT Filed: Jan. 14, 1994

[86] PCT No.: PCT/EP94/00099

§ 371 Date: Sep. 13, 1994

§ 102(e) Date: Sep. 13, 1994

[87] PCT Pub. No.: WO94/15506

PCT Pub. Date: Jul. 21, 1994

[30] Foreign Application Priority Data

Jan. 15, 1993 [DE] Germany ..... 9300473 U

[51] Int. Cl.[6] ..... A44B 21/00

[52] U.S. Cl. ..... 24/510; 24/499; 24/516

[58] Field of Search ..... 24/510, 509, 498, 24/499, 504, 516, 523; 223/91, 93

[56] References Cited

U.S. PATENT DOCUMENTS

| | | | |
|---|---|---|---|
| 1,893,508 | 1/1933 | Rosenberg | 223/93 |
| 2,237,731 | 4/1941 | Freysinger | 24/516 |
| 2,569,371 | 9/1951 | Cohen . | |
| 2,782,482 | 2/1957 | Bartil et al. . | |
| 3,456,262 | 7/1969 | Coon . | |
| 4,175,366 | 11/1979 | Bigelow et al. . | |
| 4,382,531 | 5/1983 | Bisk et al. | 223/91 |
| 4,722,120 | 2/1988 | Lu . | |

FOREIGN PATENT DOCUMENTS

| | | |
|---|---|---|
| 7107670 | 10/1971 | Germany . |
| 9004752 | 4/1990 | Germany . |
| 9014462 | 10/1990 | Germany . |

*Primary Examiner*—Victor N. Sakran
*Attorney, Agent, or Firm*—Hughes, Multer & Schacht

[57] ABSTRACT

A clamp for arrangement on a carrying arm is described. The clamp has a first and a second clamp half (10, 20) with in each case two lateral angle pieces (12; 21 ), in which are located a hole (14; 23) for positioning the clamp halves (10, 20) on the carrying arm, whereby the angle pieces (12, 21) which are directed against each other lie pairwise against each other and in each case one angle piece (21) of each clamp half (10, 20) lies on the inside and the other angle piece (12) of the same clamp half (10, 20) lies on the outside, and a legged spring (4) which lies between the clamp halves (10, 20) and keeps the clamps (3) closed. The internal angle piece (21) of one clamp half (10; 20) interlocks rotatably with the external angle piece (12) of the other clamp half (20; 10), and the legged spring (4) fills, in axial direction, the space between the internal angle pieces (21) in each case of the clamp halves (10, 20).

22 Claims, 15 Drawing Sheets

A–A

A–A

CLAMP

Figure 1:
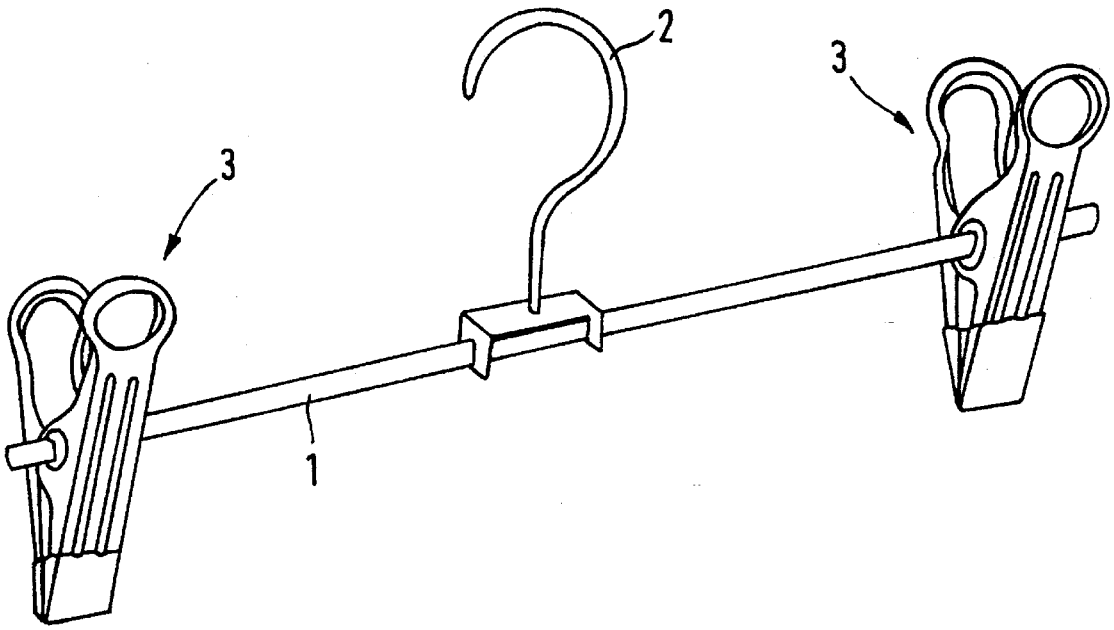

The invention relates to a clamp for arrangement on a carrying arm e.g. of a trouser or skirt hanger. The clamp has two clamp halves, with in each case two lateral angle pieces in which are located a hole for the positioning of the clamp halves on the carrying arm. The angle pieces, directed against each other, of the clamp halves abut each other pairwise and one angle piece of every clamp half lies on the inside and the other angle piece of the same clamp half lies on the outside. Arranged between the clamp halves is a legged spring which keeps the clamps closed.

Such a clamp is known from DE-U-71 07 670 and DE-U-90 04 752. The angle pieces of the clamp halves are flat sheet-steel parts. An advantage of this structure is that the two clamp halves can be of identical design, as a result of which stock-keeping is simplified. For assembly, the legged spring and the two clamp halves must be pushed onto the carrying arm, requiring to be held together by hand or mechanically. This makes assembly difficult.

Known from DE-U-90 14 462 is a similar clamp in which the two angle pieces of the first clamp half lie between those of the second clamp half and the edge of the holes in the angle pieces of the first clamp half is arched outwards and engages with correspondingly designed holes in the angle pieces of the second clamp half. The clamps can therefore be pre-assembled, i.e. the two clamp halves and the spring lying between them form an independent structural group. This simplifies the production process, as the clamps can be stored pre-assembled and do not need to be pushed onto the carrying arm until later. It is thereby possible to react more quickly to customers' wishes for carrying arms of a certain length or design. However, the differently designed clamp halves inevitably entail higher production costs.

The object of the invention is to provide a clamp which, on the one hand, can be mechanically pre-assembled and, on the other, entails the lowest possible manufacturing costs.

According to the invention, this object is achieved in that, in the case of a clamp of the design mentioned initially, the internal angle piece of one clamp half interlocks rotatably with the opposite, external angle piece of the other clamp half, and the legged spring fills, in axial direction, the space between the internal angle pieces in each case of the clamp halves.

In the assembled state, one angle piece of each clamp half thus lies on the inside and the other angle piece of the same clamp half on the outside. The two clamp halves can therefore be structurally identical.

The fact that the legged spring fills, in axial direction, the space between the internal angle pieces in each case of the clamp halves means that the axis of the legged spring roughly coincides with the axis of the carrying arm which is inserted through the holes of the angle pieces. For preference, not only does the legged spring fill the space between the internal angle pieces in each case of the clamp halves in axial direction, but the legged spring is also slightly axially prestressed. This prestressing of the spring can lie in the range between 0 and 50N and is preferably 25 to 30N for a skirt or trouser hanger.

Various configurations are possible for the interlocking of an internal angle piece and an external angle piece. The end-zone of the internal angle piece can e.g. be of semi-circular design, this semi-circular zone in whose centre the hole lies being elbowed outwards. The corresponding external angle piece has a hole with a greater diameter which corresponds to the outer diameter of the elbowed zone of the internal angle piece with a play of preferably 0.5 to 1 mm, so that the elbowed zone is accommodated in the hole of the external angle piece.

To achieve as good as possible an abutment of the angle pieces against each other, preferably only a narrow semicircular edge zone of the hole is pushed out from the internal angle piece, while the circular zone surrounding this edge zone, which is likewise roughly semicircular-annular, is left in the original plane of the angle piece. From this there results a good holding together of the two clamp halves and of the legged spring lying between them. The internal angle piece simultaneously offers a large abutment surface for the legged spring, such that the legged spring lies at its axial ends exclusively against the internal angle pieces. To avoid a displacement of the legged spring, this preferably also fills the space between the clamp halves in radial direction. In this way, the legged spring is also prevented, at the same time, from interfering or being in the way when the clamp is being pushed onto the carrying arm.

Instead of elbowing the internal angle pieces outwards in an edge zone around the hole, the external angle piece can also be elbowed inwards.

Another possibility is to provide the holes of the internal angle piece, around the hole or at least on a part-zone of the edge of the hole, with an outwardly-projecting collar. Conversely, the hole of the external angle piece can be provided with an inwardly projecting collar.

The engagement between the angle pieces can also be achieved without modifying the hole, e.g. by moulding on, at that end of the external angle piece which is remote from the clamp half, an inwardly-pointing small hook which engages in a sickle-shaped slot in the internal angle piece. A particularly simple design results if the end of the internal angle piece is bent over outwards in a zone of two or three millimeters along a line parallel to the clamp half. Provided in the external angle piece is a rectangular aperture which accommodates this bend and simultaneously makes possible an adequate swivel angle between the two clamp halves. The rectangular aperture will generally be so large that it passes into the hole.

The carrying arm can be a rod with a round cross-section or with an oval cross-section with rolled-on flattened sections, or have any other cross-section. If the rod has a markedly flattened cross-section, it can be arranged through an appropriate shaping of the holes that the clamp halves can rotate in only a limited angle range around the rod. In this way, it can be ensured that the clamps are always in the correct gripping position on the rod, as described in DE-U 90 04 752.

The clamp halves are expediently punched out from steel sheet and have a grip end and a clamping end, whereby the clamp pieces protrude at right angles from the side line of the clamp halves roughly in the centre.

The legged spring is a coiled spring with projecting leg ends. To achieve a spring characteristic with as constant as possible a force exertion upon opening of the clamp by pressing together of the grip ends, the legged spring has as great as possible a number of coils. For the clamp of a trouser or skirt hanger, the legged spring has e.g. four coils and is made from galvanized spring wire, DIN 2076-B-1.5, with a diameter of 1.5 mm. The clear width of the coiled middle zone can be ca. 8.5 mm. The leg ends project at an angle of 75° when the legged spring is extended and develop a force of ca. 30N for a leg-end length of 26 mm and an angle of opening of 15°. Roughly this force must be expended when opening the clamp.

The leg ends project tangentially from the coiled main body of the coiled spring and also continue the pitch, so that the tips of the leg ends are at a distance in axial direction which is greater than the axial length of the main body of the legged spring. The consequence of this is that the leg ends do not impact on the clamp halves centrally and symmetrically, but abut laterally at the edge of the grip ends, and tilt the two clamp halves towards each other. This tilting is advantageous, as it fixes the clamp on the carrying arm, so that the clamps do not shift e.g. under the weight of the item of clothing on the carrying arm. The direction of coiling of the legged spring is expediently also chosen so that the axial force component exerted by the leg ends strengthens the engagement between the angle pieces abutting pairwise. If e.g. the edge zone of the hole of the internal angle pieces is elbowed outwards, the leg ends lie against the side of the grip halves at which the internal angle pieces project. If the fixing of the clamp on the carrying arm is not necessary, the leg ends can also be bent back in axial direction, so that they impinge centrally on the grip ends of the clamp halves.

The clamps according to the invention can be provided for arrangement on a carrying arm of any desired type. This may be the straight central piece of a trouser or skirt hanger. The clamp can also be pushed on the axle journal-like, straight end of a hook which for its part is suspended from the carrying arm. The carrying arm or the hook end can also be slightly bent, as long as this does not disturb the pushing on of the clamp. On a piece of wire bent into a circle e.g. a plurality of clamps can be pushed on to hold a plurality of items in a circular arrangement.

Figure 2:
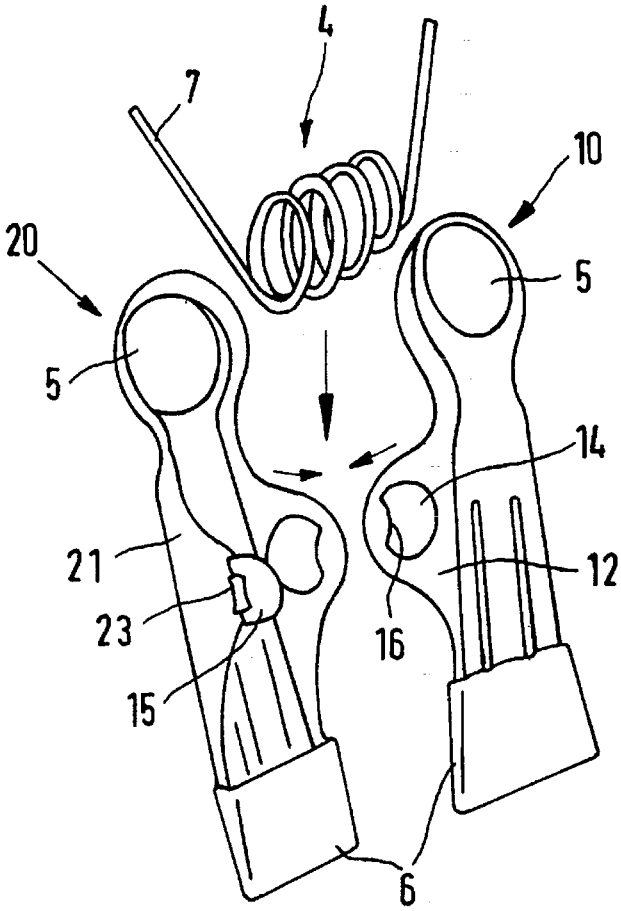
Figure 3:
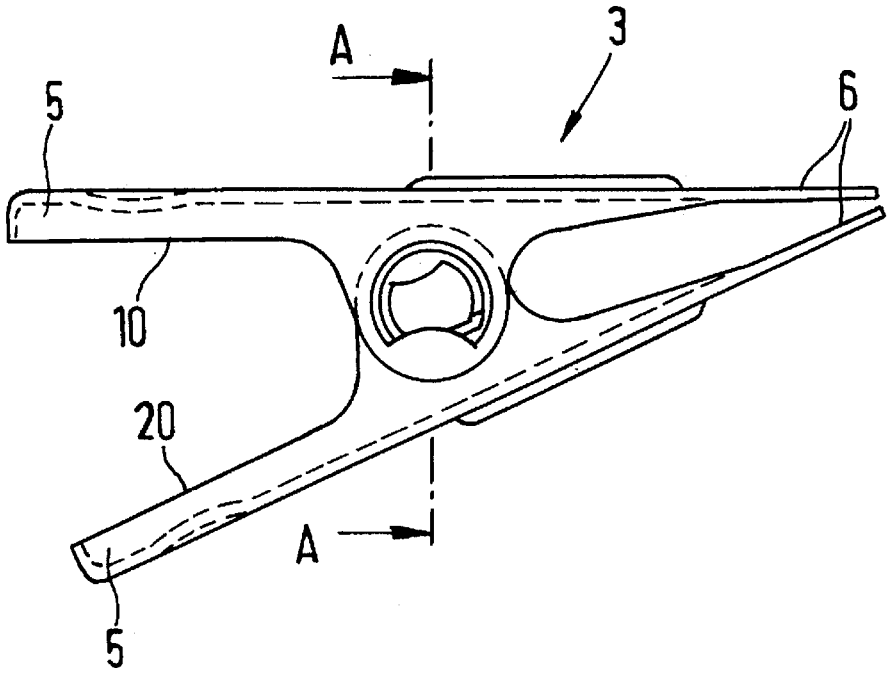
Figure 4:
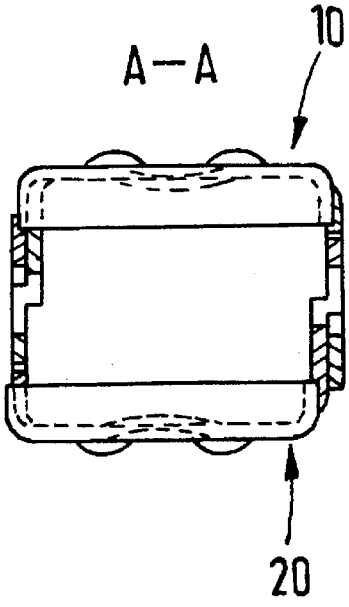
Figure 5:
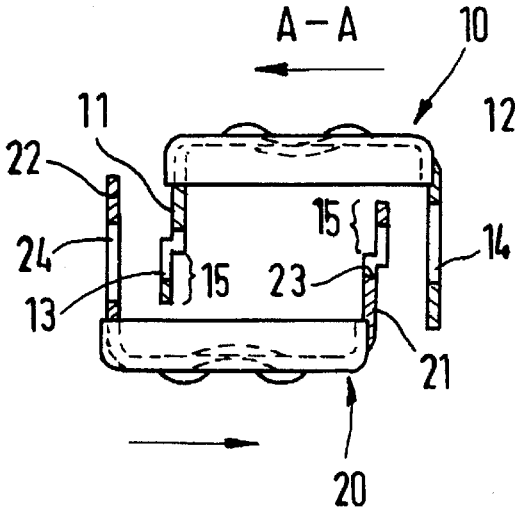
Figure 6:
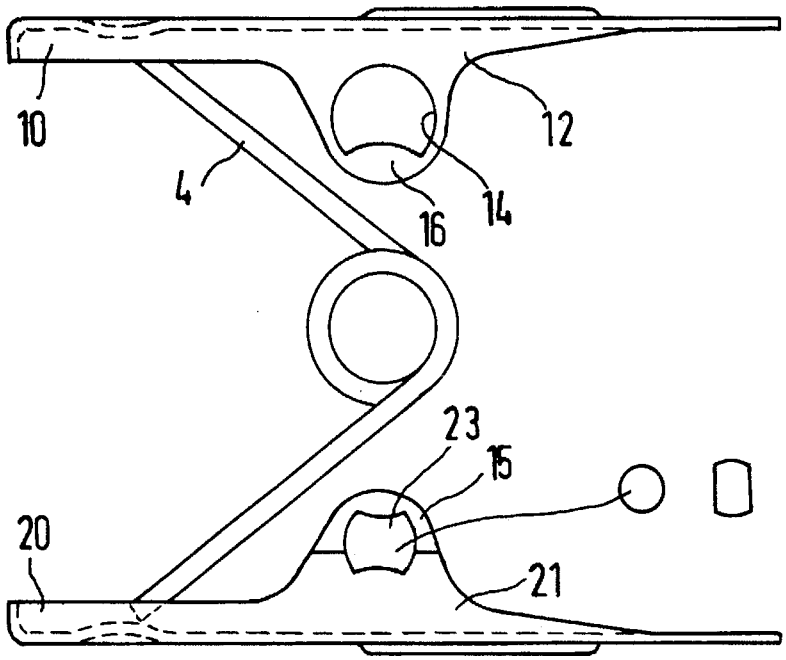
Figure 7:
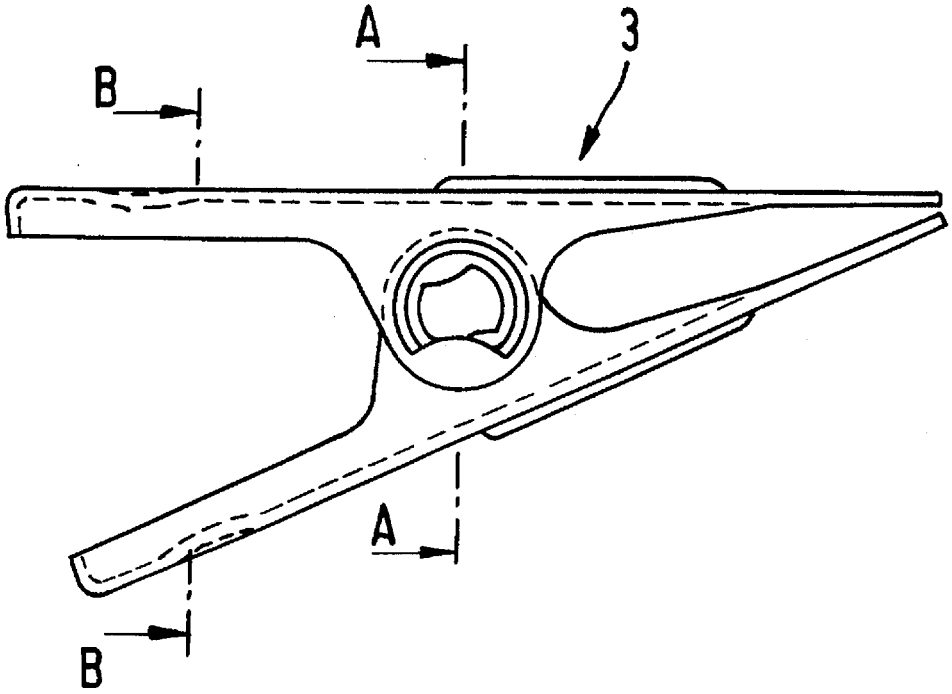
Figure 8:
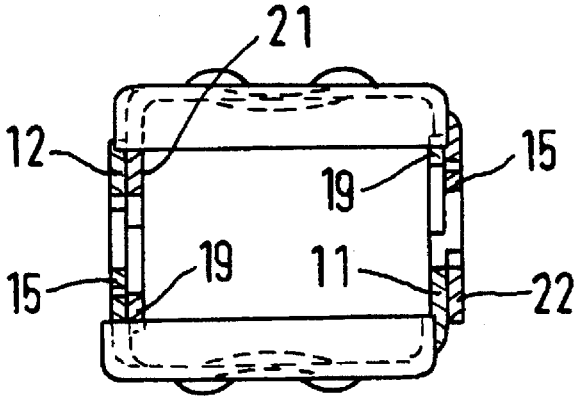
Figure 9:
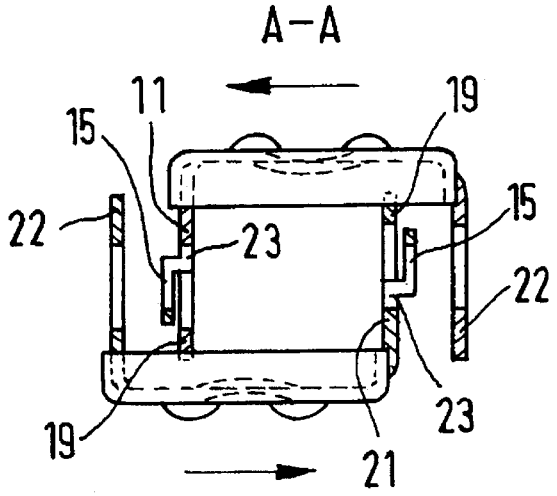
Figure 10:
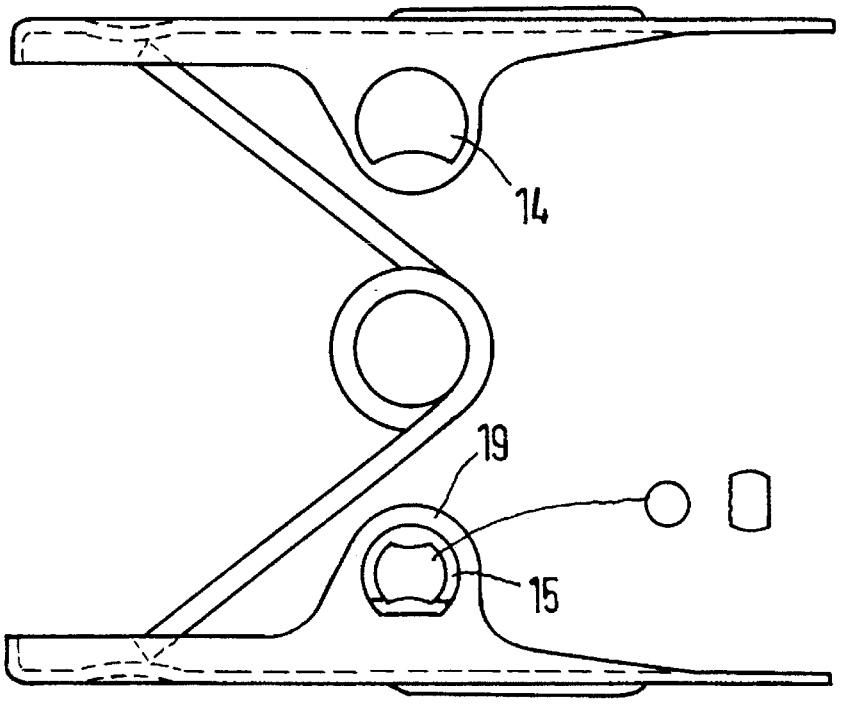
Figure 11:
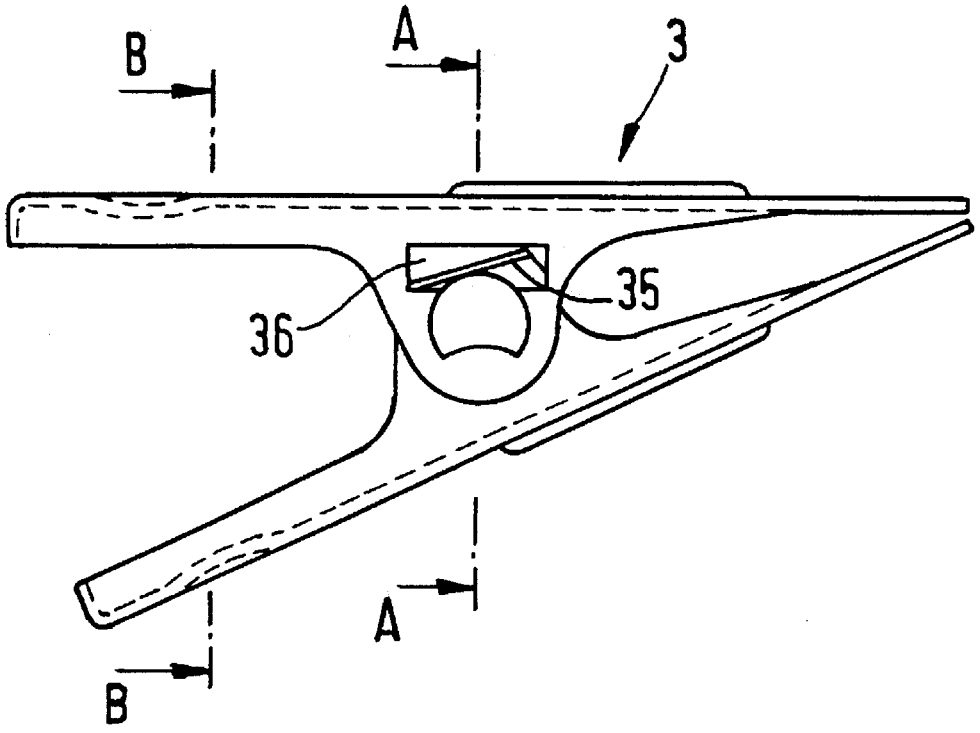
Figure 12:
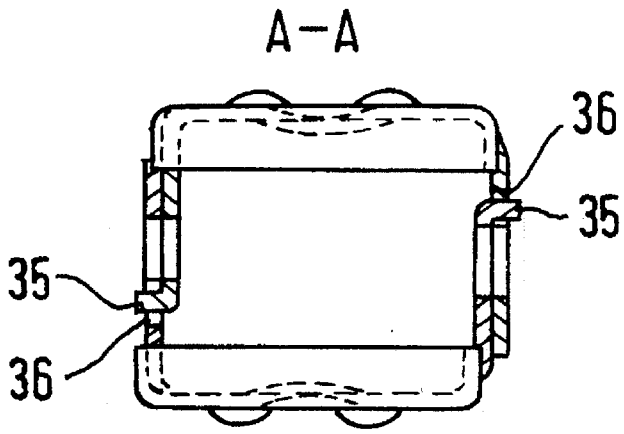
Figure 13:
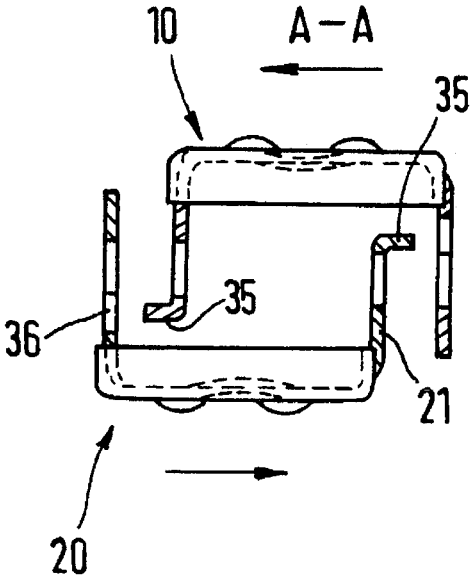
Figure 14:
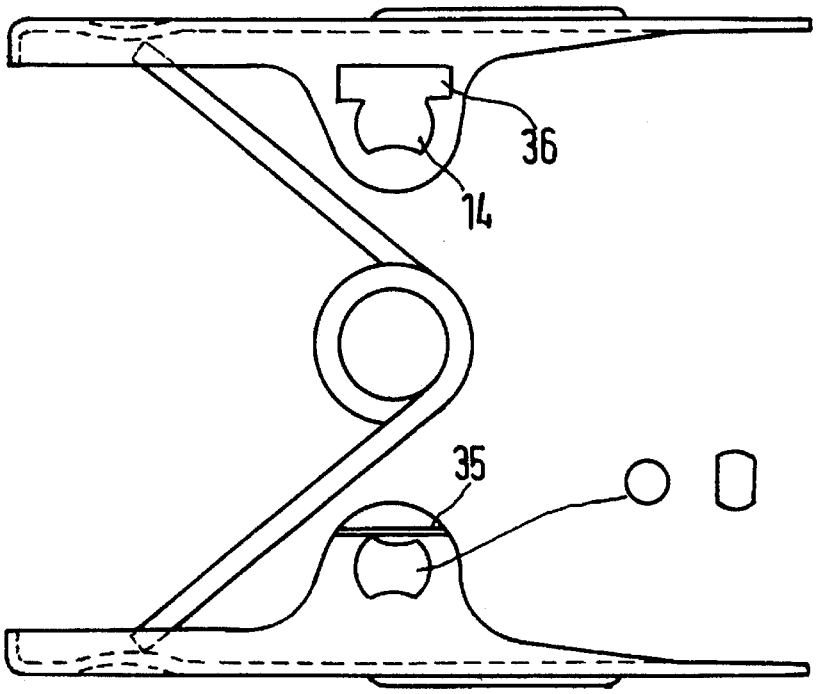
Figure 15:
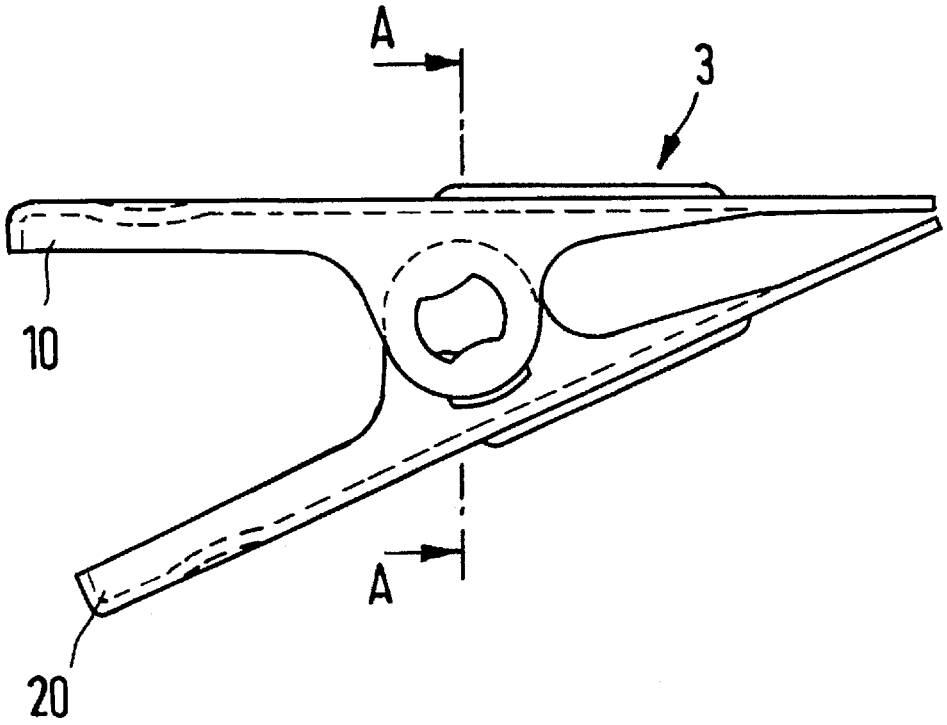
Figure 16:
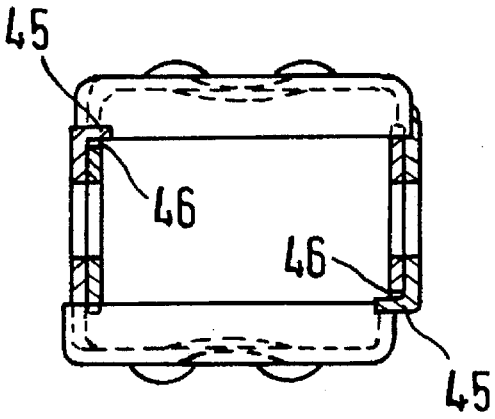
Figure 17:
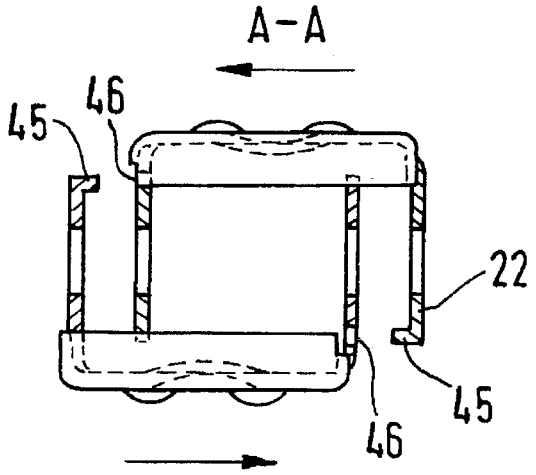
Figure 18:
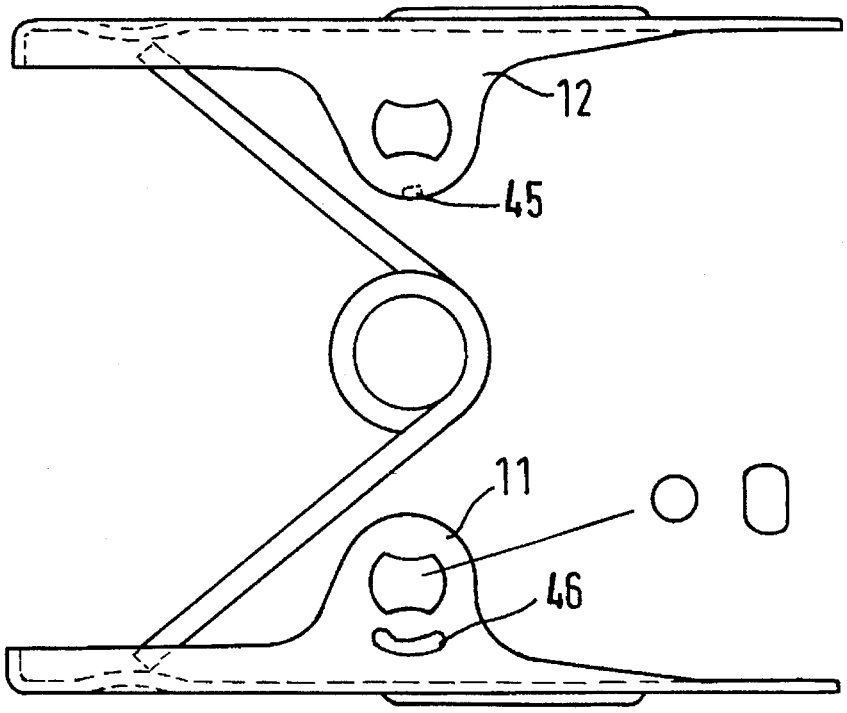
Figure 19:
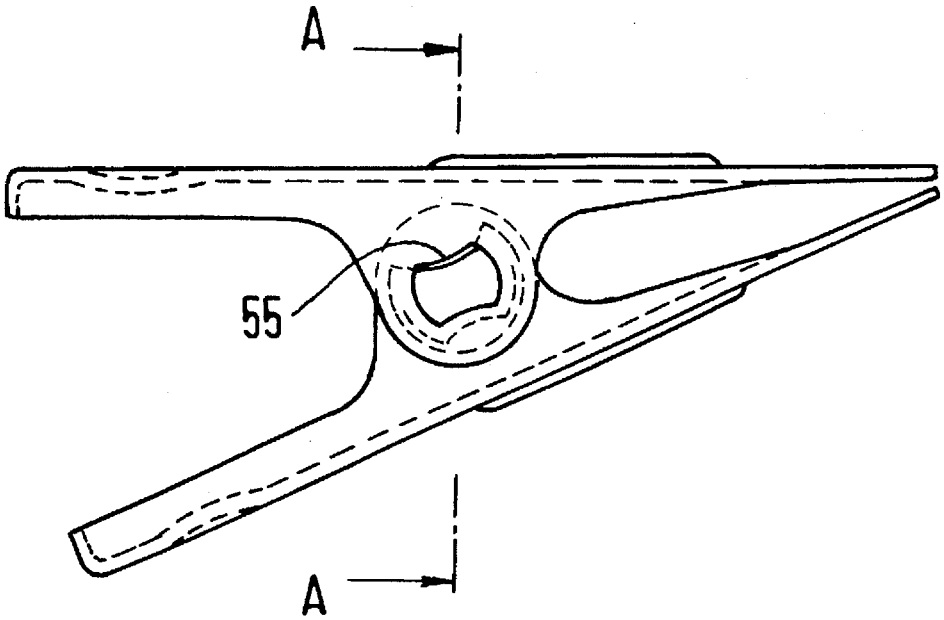
Figure 20:
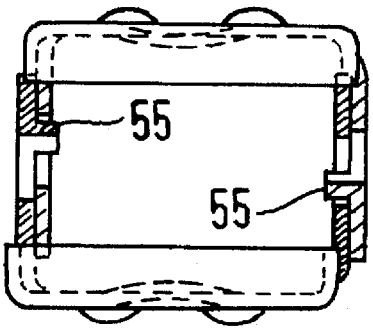
Figure 21:
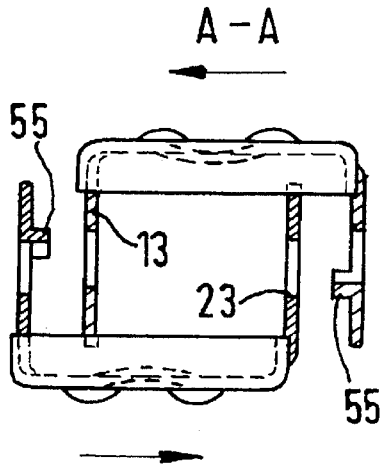
Figure 22:
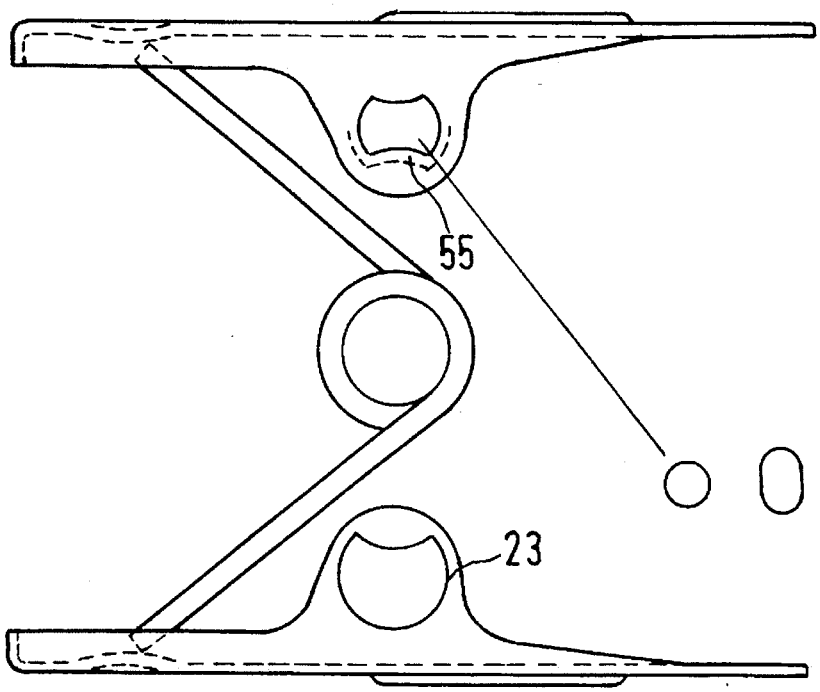
Figure 23:
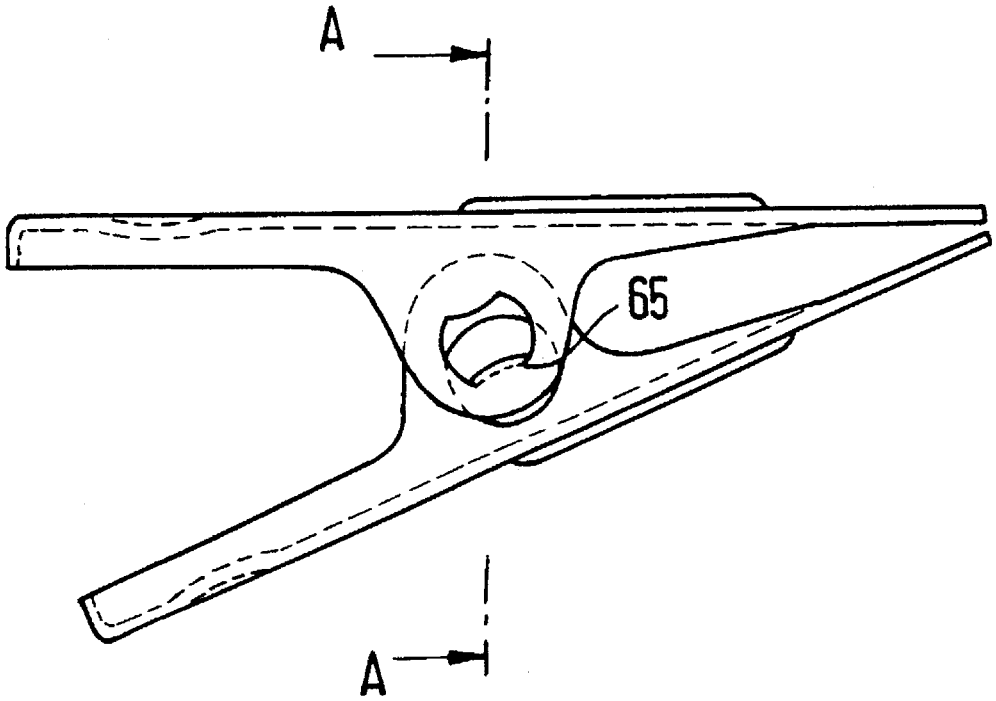
Figure 24:
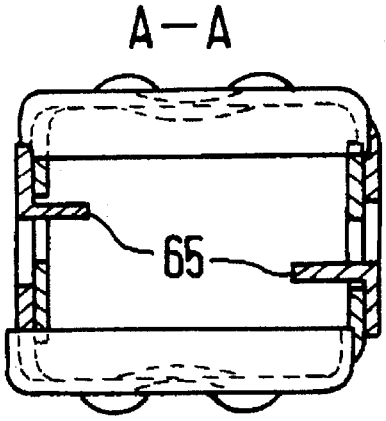
Figure 25:
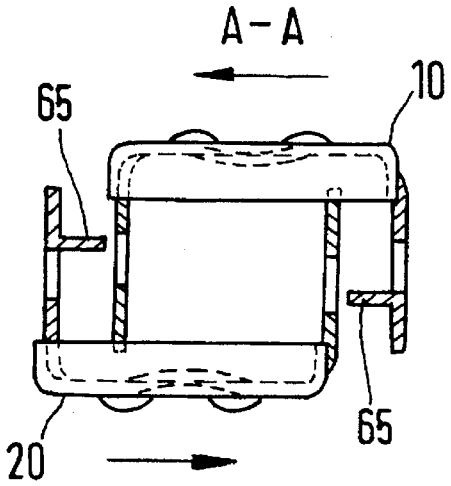
Figure 26:
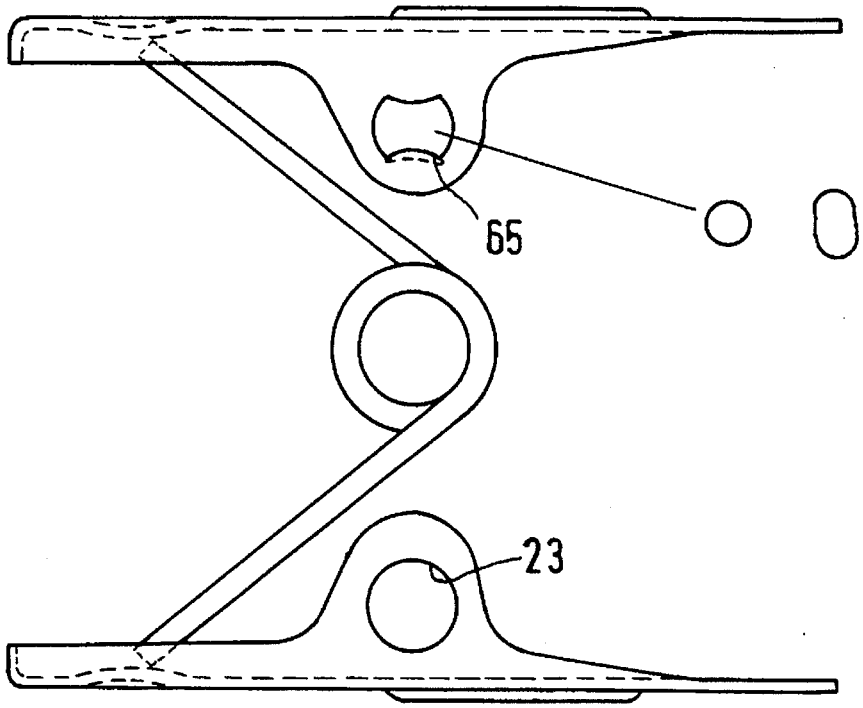
Figure 27:
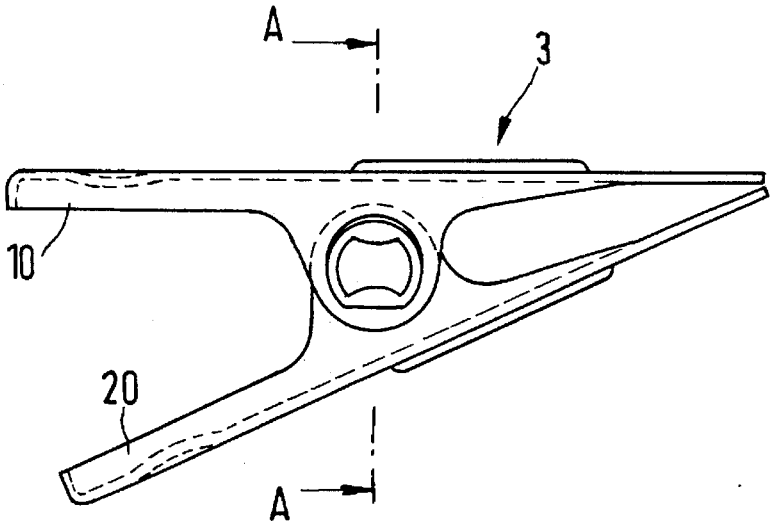
Figure 29:
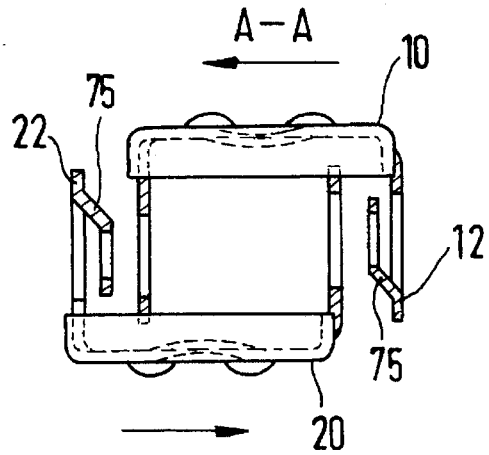
Figure 28:
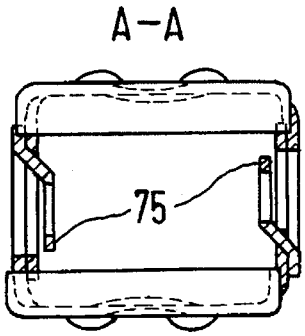
Figure 30:
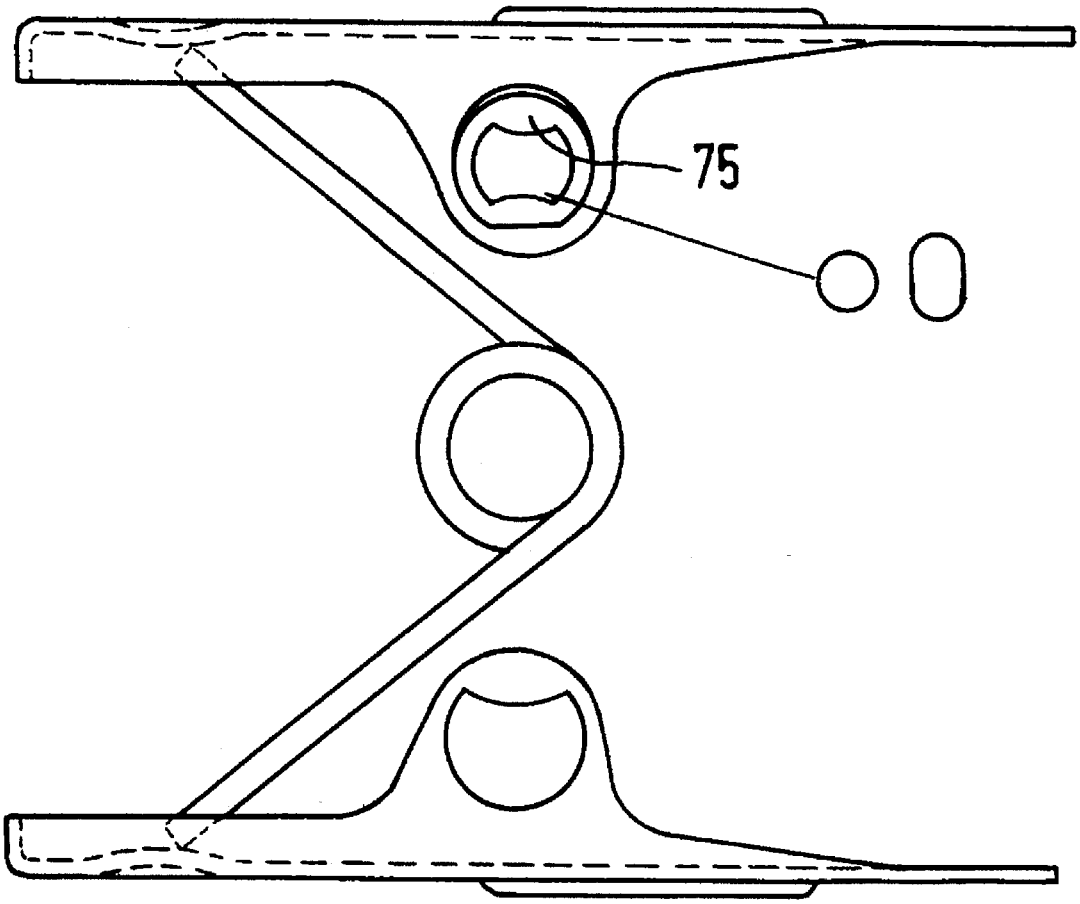

Embodiments of the invention are described below with reference to the drawing. Shown are:

FIG. 1 a perspective view of a clamp hanger;

FIG. 2 a perspective exploded representation of a clamp;

FIG. 3 a first embodiment of the clamp hanger in side view in the direction of the carrying arm;

FIG. 4 a section along A—A in FIG. 3 without the legged spring;

FIG. 5 a representation similar to that of FIG. 4, whereby the angle pieces of the clamp halves are not yet interlocking;

FIG. 6 an exploded representation of the clamp hanger from the side;

FIGS. 7 to 10 representations similar to those of FIGS. 3 to 6 of a second embodiment;

FIGS. 11 to 14 representations similar to those of FIGS. 3 to 6 of a third embodiment;

FIGS. 15 to 18 representations similar to those of FIGS. 3 to 6 of a fourth embodiment;

FIGS. 19 to 22 representations similar to those of FIGS. 3 to 6 of a fifth embodiment;

FIGS. 23 to 26 representations similar to those of FIGS. 3 to 6 of a sixth embodiment;

FIGS. 27 to 30 representations similar to those of FIGS. 3 to 6 of a seventh embodiment.

The embodiments show clamps for a clamp hanger, this being a trouser or skirt hanger, i.e. a coathanger with clamping devices for clamping fast the items of clothing. According to FIG. 1, such a clamp holder has a carrying arm 1, from which a hanging hook 2 projects upwards in the middle. Positioned at both ends of the carrying arm are downwards-opening clamps 3 to which e.g. trousers or a skirt can be clamped fast. The clamps 3 are displaceable on the carrying arm 1, so that the distance between them can be matched to the width of the item of clothing. According to FIGS. 2 to 6, each clamp 3 consists of two structurally identical clamp halves 10, 20 which are formed from an elongated sheet-metal strip with a grip end 5 and a clamping end 6. Angle pieces 11, 12 and 21, 22 project at right angles, roughly in the middle, from the side lines of the clamp halves 10, 20 respectively. Located in the angle pieces are holes 13, 14 and 23, 24 respectively through which the carrying arm passes (FIG. 1). The two clamp halves 10, 20 of a clamp 3 lie opposite each other on the carrying arm 1, whereby the clamp halves 10, 20, as can be seen from FIGS. 4 and 5, are somewhat offset against each other laterally because of the material thickness of the angle pieces 11, 12 and 21, 22 respectively.

Of the two angle pieces 11, 12 and 21, 22 respectively of each clamp half 10 or 20, in the assembled state one clamp half 11 or 21 lies inside in each case, while the other clamp half 12 or 22 lies outside against an inner angle piece 21 or 11 respectively of the other clamp half 20 or 10.

A legged spring 4 which is a coiled spring with projecting leg ends also sits on the carrying arm 1 inside the clamp 3 and presses the internal angle pieces 11, 21 in each case of the two clamp halves 10, 20 with a slight force outwards against the outer angle pieces 22, 12 of the other clamp half 20, 10 in each case. In the assembled state, legged spring 4 is slightly compressed and is thereby prestressed. Its diameter is as large as possible, so that it virtually fills, in radial direction, the whole space between the clamp halves 10, 20.

The angle pieces 11, 12 and 21, 22 respectively and the holes 13, 14 and 23, 24 respectively in them are designed such that they interlock under the force of the legged spring 4 and as a result already form a cohesion-displaying unit before the pushing onto the carrying arm 1. In particular, the engagement between the angle pieces 11, 22 and 21, 12 respectively is so firm that the clamp halves 10, 20 are not separated as a result of the transverse component of the spreading force exerted by the leg ends 7 on the grip ends 5.

In the case of the first embodiment, shown in FIGS. 2 to 6, to achieve the engagement, a semicircular edge zone 15 of the hole 13, 23, which edge zone is the outer end of the inner angle pieces 11, 21, is laterally elbowed or offset outwards by about the thickness of the material along a line which runs parallel to the longitudinal extension of the clamp halves 10, 20 and through the central point of the holes 13 and 23 respectively. The whole of the offset edge zone 15 is accommodated by the hole 14 or 24 respectively of the outer angle piece 12 or 22 of the other clamp half 10, 20 in each case. The hole 14, 24 in the outer angle piece 12, 22 thus has a perceptibly greater diameter than the hole 13, 23 in the inner angle piece 11, 21. Under the axial force of the legged spring 4, the offset edge zone 15 is pressed in locking manner into the hole 14, 24 in the outer angle piece, with the result that the clamp halves 10, 20 no longer separate automatically. During the assembly of the clamp hanger there is consequently the possibility of pre-assembling the clamps 3 without carrying arm 1 and only later pushing them onto a carrying arm 1 of the desired length.

The shape of the holes 13, 14 and 23, 24 respectively also takes account of the cross-section of the carrying arm 1. If the carrying arm 1 has a round cross-section, the hole 13, 23 of the inner angle piece 11, 21 also has a round cross-section with some play vis-à-vis the diameter of the carrying arm 1, so that movement is possible. The shape of the hole 14, 24 in the outer clamp half 12, 22 corresponds approximately to a three-quarter moon (FIG. 6). The diameter is so chosen that the hole 14, 24 can accommodate the offset section 15 of the inner angle piece 11, 21 and there is a play of ca. 0.5 to 1 mm. From that end of the outer angle piece 12, 22 which is remote from the clamp half 10, 20, a projection 16 protrudes into the hole 14, 24. The projection 16 protrudes into the hole 14, 24 to the point where its distance from the circle centre of the hole 14, 24 roughly corresponds to the radius or to the half cross-section dimension of the carrying arm 1 and it lies against the carrying arm 1 in the assembled state. Through the projection 16 in the hole 14, 24, friction on the elbowed edge zone 15 inside the hole 14, 24 is avoided. The holes 13, 14, 23, 24 consequently have contact with the carrying arm 1 and hinge about the carrying arm 1, as a result of which, on the one hand, the clamp 3 is readily accessible and, on the other, the clamp halves 10, 20 are locked under the diagonal direction of force between the leg ends 7 on the carrying arm 1, with the result that they do not shift e.g. under the pull of a hem of a skirt on the carrying arm 1.

In general, the carrying arm 1 has a flattened cross-section. In conjunction with the shaping described in DE-U-90 04 752 for the hole of the inner angle piece 11, 21, the permissible angle of rotation of the clamp halves on the carrying arm can be restricted as a result. In FIG. 6, the inner angle piece 11 has such a hole formed by two concave boundary lines and two convex boundary lines.

In the case of the second embodiment, shown in FIGS. 7 to 10, only a semi-circular edge zone 15 is punched out and elbowed around the hole 13, 23 of the inner angle piece 11, 21, with the result that a semi-circular annular zone 19, which surrounds the elbowed edge zone 15, remains in the plane of the angle piece 11, 21. The resultant advantage, compared with the first embodiment, is that the legged spring 4 can lie with its axial ends only against the inner angle pieces 11, 21 and the abutment surface between the inner and outer angle pieces 11, 21 and 12, 22 respectively is increased. The clamps 3 can thereby be opened more smoothly and freer from friction.

In the case of the third embodiment, shown in FIG. 11 to 14, the zone 35 lying beyond the hole 13, 23 of the inner angle piece 11, 21 is bent over outwards and there is located in the outer angle piece 12, 22 a rectangular aperture 36 in which the bent-over zone 35 engages. The width of the aperture 36 is to be so chosen that a swivel movement of the two clamp halves 10, 20 about a determined angle relative to each other is possible. The hole 13, 23 and 14, 24 in the inner and outer angle pieces 11, 21 and 12, 22 respectively have the same dimensions in this case, whereby the hole 14, 24 in the outer angle pieces 12, 22 passes into the aperture 36, since in the embodiment shown the elbowed zone 35 joins directly onto the hole 13, 23 of the inner angle piece 11, 21.

Whereas, in the case of the three embodiments shown in FIGS. 2 to 14, the engagement between the inner and outer angle pieces 11, 21 and 12, 22 respectively was achieved by virtue of the fact that parts of the inner angle pieces 11, 21 are outwardly offset, elbowed or bent over and engage in corresponding apertures or holes 14, 24 in the outer angle pieces 12, 22, in the case of the fourth embodiment, which is shown in FIGS. 15 to 18, engagement is achieved by virtue of the fact that there project inwardly, at the ends of the outer angle pieces 12, 22, noses 45 which engage in sickle-shaped apertures 46 of the inner angle pieces 11, 21. The angle range covered by the sickle-shaped aperture 46 is based on the swivel angle of the clamp halves 10, 20 and the width of the nose 45.

In the case of the fifth embodiment, which is shown in FIGS. 19 to 22, the external edge zone of the hole in the outer angle piece 12, 22 is provided with an inwardly projecting collar 55 and the diameter of the inner hole 13, 23 is increased so that it can accommodate the collar 55.

With the sixth embodiment, which is shown in FIGS. 23 to 26, there is provided, along the convex outer boundary line of the hole 14, 24 of the outer angle piece 12, 22, a likewise convexly shaped bent element 65, which engages in the hole 13, 23 of inner angle piece 11, 21. The hole 13, 23 is offset to the main part of the grip half 10, 20 to achieve, in the assembled state, an equal distance of carrying arm 1 from both clamp halves 10, 20.

In the case of the seventh embodiment, which is shown in FIGS. 27 to 30, an edge zone 75 of roughly a three-quarter circular arc is punched out around the hole 14, 24 of the outer angle piece 12, 22 and elbowed inwards, so that the elbowed edge zone 75 remains connected only to the outer end of the angle piece 12, 22. The hole 13, 23 in the inner angle piece 11, 21 has the same shape as the hole 14, 24 in the outer angle piece 12, 22 of the second embodiment, which is shown in FIGS. 7 to 10.

The embodiments differ in the means by which, under the pressure of the legged spring 4, an engagement is achieved between the inner and outer angle pieces 11, 21 and 12, 22 respectively. The decision as to which version is the most favourable in an individual case depends on whether the clamps 3 are assembled by hand or pre-assembled mechanically and what tools are available for shaping the clamp halves 10, 20 and the engagement means provided at same.

We claim:

1. A clamp for arrangement on a carrying arm (1) with a first and a second clamp half (10, 20) with in each case two lateral angle pieces (11, 12; 21, 22), in which are located a hole (13, 14; 23, 24) for the positioning of the clamp halves (10, 20) on the carrying arm (1), whereby the angle pieces (11, 22 and 12, 21) which are directed against each other lie pairwise against echo other and in each case one angle piece (12; 21) of each clamp half (210, 20) lies on the inside and the other angle piece (12; 22) of the same clamp half (10, 20) lies on the outside, and with a legged spring (4) which lies between the clamp halves 10, 20) and keeps the clamps (3) closed, characterized in that the internal angle piece (11; 21) of one clamp half (10, 20) interlocks rotatably with the external angle piece (22; 12) of the other clamp half (20; 10), by parts (15) of the inner angle pieces (11; 21) being outwardly offset, elbowed or bent over and engaging in corresponding apertures (36) or the holes (14; 24) in the outer angle pieces (12; 22) or, conversely, parts (45, 55, 65, 75) of the outer angle pieces (12; 22) being inwardly offset, elbowed or bent over and engaging in corresponding apertures or the holes (13; 23) of the inner angle pieces (11; 21), and the legged spring (4) fills, in axial direction, the space between the internal angle pieces (11; 21) in each case of the clamp halves (10, 20).

2. Clamp according to claim 1, characterized in that the legged spring (4) presses against the internal angle pieces (11, 21).

3. Clamp according to claim 2, characterized in that a semi-circular edge zone (15) of the hole (13, 23) of the inner angle piece (11, 21) is outwardly elbowed or offset and that the hole (14, 24) of the abutting outer angle piece (11, 22) has a diameter such that it can accommodate the elbowed zone (15).

4. Clamp according to claim 2, characterized in that a projection (16) which extends as far as the carrying arm (1) protrudes into the hole (14, 24) of the outer angle piece (12, 22).

5. Clamp for arrangement on a carrying arm (1) with a first and a second clamp half (10,20) with in each case two lateral angle pieces (11, 12; 21, 22), in which are located a hole (13, 14, 23, 24) for the positioning of the clamp halves (10, 20) on the carrying arm (1), whereby the angle pieces (11, 22 and 12, 21) which are directed against each other lie pairwise against each other and in each case one angle piece (12; 21) of each clamp half (10, 20) lies on the inside and the other angle piece (12; 22) of the same clamp half (10, 20) lies on the outside, and with a legged spring (4) which lies between the clamp halves (10, 20) and keeps the clamps (3) closed, characterized in that the internal angle piece (11, 21) of one clamp half (10;20) interlocks rotatably with the external angle piece (22; 12) of the other clamp half (20; 10), the legged spring (4) fills, in axial direction, the space between the internal angle pieces (11; 21) in each case of the clamp halves (10, 20), and a semi-circular edge zone (15) of the hole (13, 22) of the inner angle piece (11, 21) is outwardly elbowed or offset and that the hole (14, 24) of the abutting outer angle piece (11, 22) has a diameter such that it can accommodate the elbowed zone (15).

6. Clamp according to claim 5, characterized in that the legged spring (4) presses against the internal angle pieces (11, 21).

7. Clamp according to claim 6, characterized in that the elbowed edge zone (15) is surrounded by an annular zone (19) which lies in the plane of the angle piece (11, 21).

8. Clamp according to claim 6, characterized in that a projection (16) which extends as far as the carrying arm (1) protrudes into the hole (14, 24) of the outer angle piece (12, 22).

9. Clamp according to claim 5, characterized in that the elbowed edge zone (15) is surrounded by an annular zone (19) which lies in the plane of the angle piece (11, 21).

10. Clamp according to claim 5, characterized in that a projection (16) which extends as far as the carrying arm (1) protrudes into the hole (14, 24) of the outer angle piece (12, 22).

11. A clamp hangar comprising a carrying arm and at least two clamps mounted to the carrying arms, each of said clamps comprising:

a. a first and a second clamp half (10, 20) with in each case two lateral angle pieces (11, 12; 21, 22), in which are located a hole (13, 14; 23, 24) for the positioning of the clamp halves (10, 20) on the carrying arm (1), whereby the angle pieces (11, 22 and 12, 21) which are directed against each other lie pairwise against each other and in each case one angle piece (12; 21) of each clamp half (10,20) lies on the inside and the other angle piece (12; 22) of the same clamp half (10, 20) lies on the outside, and b. with a legged spring (4) which lies between the clamp halves (10, 20) and keeps the clamps (3) closed, characterized in that a. the internal angle piece (11; 21) of one clamp half (10; 20) interlocks rotatably with the external angle piece (22; 12) of the other clamp half (20; 10), and b. the legged spring (4) fills, in axial direction, the space between the internal angle pieces (11; 21) in each case of the clamp halves (10, 20) and a semi-circular edge zone (15) of the hole (13, 23) of the inner angle piece (11, 21 is outwardly elbowed or offset and that the hole (14, 24) of the abutting outer angle piece (11, 22) has a diameter such that it can accommodate the elbowed zone (15).

12. The hanger as recited in claim 11, characterized in that the legged spring (4) presses against the internal angle pieces (11, 21).

13. A clamp for arrangement on a carrying arm, and having a longitudinal axis and a lateral axis, said claim comprising:

a. a first and a second clamp half;

b. each clamp half having an outside lateral angle piece and an inside lateral angle piece, the first and second lateral angle pieces of each clamp half each having a hole means located to receive the carrying arm;

c. the first and second clamp halves being positioned with the inside and outside angles pieces of the two clamp halves extending oppositely relative to one another in overlapping relationship, with the outside angle piece of each clamp half being adjacent to, and outside of, the inside angle piece of the other clamp half;

d. one of the outside and inside angle pieces of each clamp half being formed with an interconnecting portion extending outwardly from a plane occupied by its related angle piece, into the opening means of the other of the outside and inside angle pieces adjacent thereto so as to rotatably interlock each pair of adjacent inner and outer angle pieces to prevent the first and second clamp halves from being moved away from each other;

e. spring means operably engaging the clamp halves to urge said clamp halves in a longitudinal direction into interlocking relationship.

14. The clamp as recited in claim 13, wherein the inside and outside lateral angle pieces, respectively, of the clamp halves have substantially identical configurations, whereby the first and second clamp halves can be used interchangeably with one another.

15. The clamp as recited in claim 13, wherein the interconnecting portion comprises a part of the related angle piece being offset.

16. The clamp as recited in claim 13, wherein the interconnecting portion comprises an elbowed portion of the related angle piece.

17. The clamp as recited in claim 13, wherein the interconnecting portion comprises a bent over portion of the angle piece.

18. The clamp as recited in claim 13, wherein said spring means comprises a leg spring which lies between the clamp halves to urge the clamp closed, and also engages the clamp halves to urge the clamp halves longitudinally relative to one another in interconnecting relationship.

19. The clamp as recited in claim 13, wherein said spring means comprises a coiled spring portion positioned around the carrying arm and first and second spring legged portions engaging the first and second clamp halves, respectively, so as to urge the first and second clamp halves in opposite directions longitudinally into interconnecting relationship, and also to urge said clamp halves toward a clamping position.

20. The clamp as recited in claim 13, wherein the opening means in each angle piece comprises a single opening which receives a related interconnecting portion of an adjacent angle piece and also receives said carrying arm.

21. The clamp as recited in claim 20, wherein the single hole of each angle piece has a concavely curved hole defining edge portion to engage a related interconnecting portion to facilitate limited rotational movement between the first and second clamp halves.

22. Clamp for arrangement on a carrying arm, comprising: a first and second clamp half each having two lateral angle pieces in each of which are located a hole for the positioning of the clamp halves on the carrying arm, the angle pieces of each clamp half each being positioned against respective angle pieces of the other clamp half to form cooperating pairs of inner and outer angle pieces, one angle piece of each clamp half lying on an inside of the assembled clamp and the other angle piece of the same clamp half lying on the outside of the assembled clamp, and the inner angle piece of one clamp half interlocking rotatably with the cooperating outer angle piece of the other clamp half by a part of one angle piece of each cooperating pair being offset, elbowed or bent over and engaging in a corresponding aperture or hole in the other angle piece of that cooperating pair; a legged spring which lies between the clamp halves and keeps the assembled clamp closed and fills, in the axial direction, the space between the angle pieces of the clamp halves which are on the inside of the assembled clamp.

* * * * *